United States Patent [19]

Hall et al.

[11] 4,395,239

[45] Jul. 26, 1983

[54] HYDRAULIC SYSTEM FOR MARINE PROPULSION DEVICE WITH SEQUENTIALLY OPERATING TILT AND TRIM MEANS

[75] Inventors: Charles B. Hall, Ingleside; Edward D. McBride, Waukegan, both of Ill.; Robert F. Young, Kenosha, Wis.

[73] Assignee: Outboard Marine Corporation, Waukegan, Ill.

[21] Appl. No.: 252,813

[22] Filed: Apr. 10, 1981

[51] Int. Cl.[3] ..... B63H 5/12

[52] U.S. Cl. ..... 440/61

[58] Field of Search ..... 440/56, 58–63, 440/65, 53; 91/420

[56] References Cited

U.S. PATENT DOCUMENTS

| | | | |
|---|---|---|---|
| 2,138,600 | 11/1938 | Harmon | 440/65 X |
| 3,434,449 | 3/1969 | North | 440/56 |
| 3,799,104 | 3/1974 | Kurling | 440/56 |
| 3,885,517 | 5/1975 | Borst et al. | 440/56 |
| 4,064,824 | 12/1977 | Hall et al. | 440/65 X |
| 4,096,820 | 6/1978 | Hall | 440/56 |

*Primary Examiner*—Sherman D. Basinger

*Attorney, Agent, or Firm*—Michael, Best & Friedrich

[57] ABSTRACT

Disclosed herein is a marine propulsion device comprising a trim cylinder pivotally connected to a stern bracket and to a swivel bracket, a tilt cylinder pivotally connected to a transom bracket and to the stern bracket, a reversible pump including first and second ports, a first conduit communicating between the first pump port and one end of the trim cylinder, a second conduit communicating between the first pump port and one end of the tilt cylinder, a third conduit including a third check valve dividing the third conduit into an upstream portion communicating with the second pump port and a downstream portion communicating with the other end of the trim cylinder, a fourth conduit including a fourth check valve dividing the fourth conduit into an upstream portion communicating with the second pump port and a downstream portion communicating with the other end of the tilt cylinder, and a fifth conduit including a fifth check valve communicating between the downstream portion of the third conduit and the downstream portion of the fourth conduit, and operable to prevent fluid flow from the downstream portion of the third conduit to the downstream portion of the fourth conduit, and to permit fluid flow from the downstream portion of the fourth conduit to the downstream portion of the third conduit in response to the presence of fluid under pressure above a predetermined level in the downstream portion of the fourth conduit.

14 Claims, 4 Drawing Figures

HYDRAULIC SYSTEM FOR MARINE PROPULSION DEVICE WITH SEQUENTIALLY OPERATING TILT AND TRIM MEANS

RELATED APPLICATIONS

Reference is hereby made to the following related applications, all of which are assigned to the assignee of this application and all of which are incorporated herein by reference:

Stevens application Ser. No. 159,480, filed June 16, 1980, and entitled OUTBOARD MOTOR WITH ELEVATED HORIZONTAL PIVOT AXIS, now U.S. Pat. No. 4,355,986.

Blanchard application Ser. No. 167,337, filed July 9, 1980, and entitled OUTBOARD MOTOR WITH DUAL TRIM AND TILT AXES.

Hall et al application Ser. No. 173,158, filed July 28, 1980, and entitled MARINE PROPULSION DEVICE STEERING MECHANISM.

Hall et al application Ser. No. 173,159, filed July 28, 1980, and entitled OUTBOARD MOTOR WITH TILT LINKAGE INCLUDING PIVOT LINK, now U.S. Pat. No. 4,354,848.

Hall et al application Ser. No. 173,160, filed July 28, 1980, and entitled OUTBOARD MOTOR WITH SEQUENTIALLY OPERATING TILT AND TRIM MEANS.

Hall et al application Ser. No. 173,161, filed July 28, 1980, and entitled DUAL PIVOT OUTBOARD MOTOR WITH TRIM AND TILT TOGGLE LINKAGE, now U.S. Pat. No. 4,362,513.

Hall et al application Ser. No. 173,162, filed July 28, 1980, and entitled LATERAL SUPPORT ARRANGEMENT FOR OUTBOARD MOTOR WITH SEPARATE TILT AND TRIM AXIS.

Hall et al application Ser. No. 183,209, filed Sept. 2, 1980, and entitled HYDRAULIC SYSTEM FOR OUTBOARD MOTOR WITH SEQUENTIALLY OPERATING TILT AND TRIM MEANS, now U.S. Pat. No. 4,363,629.

Blanchard application Ser. No. 189,143, filed Sept. 22, 1980, and entitled OUTBOARD MOTOR WITH STEERING ARM LOCATED AFT OF TRANSOM AND BELOW TILT AXIS.

BACKGROUND OF THE INVENTION

The invention relates generally to marine propulsion devices and, more particularly, to outboard motors including propulsion units which are steerable in a horizontal plane and tiltable in a vertical plane.

The invention also relates to hydraulic systems for power tilting of propulsion units between a lower normal running position in which the propeller is submerged in water, and a tilted or raised position in which the propeller is located for above-the-water-accessibility. Still more particularly, the invention relates to control of tilting and trimming during reverse outboard motor operation.

Various arrangements for power tilting and/or trimming of marine propulsion units are set forth in the following U.S. patents: Carpenter, U.S. Pat. No. 3,722,455, Mar. 27, 1973; Shimanckas, U.S. Pat. No. 3,847,108, Nov. 12, 1974; Borst, U.S. Pat. No. 3,863,593, Feb. 4, 1975; Borst, U.S. Pat. No. 3,885,517, May 27, 1975; Hall, U.S. Pat. No. 3,983,835, Oct. 5, 1976; Hall, U.S. Pat. No. 4,064,824, Dec. 27, 1977; Hall, U.S. Pat. No. 4,096,820, June 27, 1978; Pichl, U.S. Pat. No. 4,177,747, Dec. 11, 1979.

SUMMARY OF THE INVENTION

The invention provides a marine propulsion device comprising transom bracket means adapted to be connected to a boat transom, a stern bracket, first pivot means connecting the stern bracket to the transom bracket means for pivotal movement therebetween about a first pivot axis which is horizontal when the transom bracket means is boat mounted, a swivel bracket, second pivot means connecting the swivel bracket to the stern bracket for pivotal movement with the stern bracket and relative to the stern bracket about a second pivot axis parallel to the first pivot axis, a propulsion unit including, at the lower end thereof, a rotatably mounted propeller, means pivotally connecting the propulsion unit to the swivel bracket for steering movement relative to the swivel bracket and for common pivotal movement with the swivel bracket, a trim cylinder-piston assembly pivotally connected to the stern bracket and to the swivel bracket and including first and second ends, a tilt cylinder-piston assembly pivotally connect to the transom bracket means and to the stern bracket and including first and second ends, a reversible pump including first and second ports, first conduit means including first valve means communicating between the first pump port and the first end of the trim cylinder-piston assembly, second conduit means including second valve means communicating between the first pump port and the first end of the tilt cylinder-piston assembly, third conduit means including third valve means dividing the third conduit means into an upstream portion communicating with the second pump port and a downstream portion communicating with the second end of the trim cylinder-piston assembly, fourth conduit means including fourth valve means dividing the fourth conduit means into an upstream portion communicating with the second pump port and a downstream portion communicating with the second end of the tilt cylinder-piston assembly, and fifth conduit means including fifth valve means communicating between the downstream portion of the third conduit means and the downstream portion of the fourth conduit means, which fifth check valve means is operable to prevent fluid flow from the downstream portion of the third conduit means to the downstream portion of the fourth conduit means, and to permit fluid flow from the downstream portion of the fourth conduit means to the downstream portion of the third conduit means in response to the presence of fluid under pressure above a predetermined level in the downstream portion of the fourth conduit means.

In one embodiment in accordance with the invention, at least one of the cylinder-piston assemblies includes a cylinder having first and second ends corresponding to the first and second ends of the associated cylinder-piston assembly, a first piston located in the cylinder, a piston rod connected to the first piston and extending through the first end of the cylinder, and a floating piston located in the cylinder between the first piston and the second end of the cylinder.

In accordance with one embodiment of the invention, the marine propulsion device further includes manually operative valve means movable between a first position wherein the valve means is closed, a second position wherein the second conduit means communicates, downstream of the second valve means, with the third conduit means, downstream of the third valve means, to permit fluid flow, in response to the presence of fluid under pressure above the predetermined level, from the fourth conduit means, through the fifth conduit means, and through the third conduit means to the second conduit means, and a third position wherein the second conduit means communicates, downstream of the second valve means, with each of the third and fourth conduit means, downstream of the third and fourth valve means, to permit fluid flow between the second conduit means and the third and fourth conduit means.

In one embodiment in accordance with the invention, the marine propulsion device further includes a sump, a first pressure relief valve communicating between the sump and the third conduit means downstream of the third valve means, which first pressure relief valve is operable to open at a first pressure level, a second pressure relief valve communicating between the sump and the fourth conduit means downstream of the fourth valve means, which second pressure relief valve is operable to open at a second pressure level less than the first pressure level, and a third pressure relief valve communicating between the sump and the first pump discharge port, which third pressure relief valve is operable to open at a third pressure level substantially the same as the second pressure level.

Other features and advantages of the embodiments of the invention will become known by reference to the following general description, claims and appended drawings.

IN THE DRAWINGS

Figure 1:
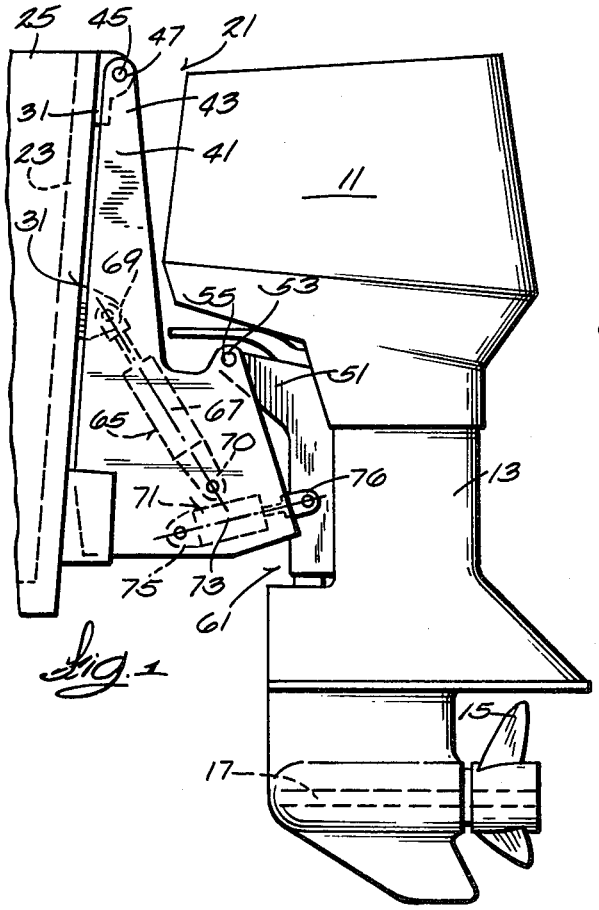
FIG. 1 is a side elevational view of an outboard motor incorporating various of the features of the invention.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 of the drawings is a marine propulsion device in the form of an outboard motor 11 having a generally conventional propulsion unit 13 including, at the lower end thereof, a rotatably mounted propeller 15 driven by a propeller shaft 17. The outboard motor 11 also includes means 21 for pivotally mounting the propulsion unit 13 for pivotal movement in both the horizontal and vertical planes relative to a transom 23 of a boat 25, whereby to provide for steering movement of the propulsion unit 13 in the horizontal plane, and to provide for movement in the vertical plane of the propulsion unit 13 between a lowermost position with the propeller 15 fully submerged in water for driving propulsion and a raised position affording above-water accessibility to the propeller 15.

The means 21 for pivotally mounting the propulsion unit 13 includes a transom bracket means 31 which can be of unitary construction, or which can comprise several parts, and which is adaped to be fixedly mounted on the transom 23 of the boat 25.

The means 21 for pivotally mounting the propulsion unit 13 also includes a stern bracket 41 having an upper end 43, as well as first or upper pivot means 45 located rearwardly of the boat transom 23 and connecting the upper end 43 of the stern bracket 41 to the transom bracket means 31 for pivotal movement of the stern bracket 41 about a first or upper pivot axis 47 which is horizontal when the transom bracket means 31 is boat mounted. Any means for effecting such pivotal connection can be employed.

The means 21 for pivotally mounting the propulsion unit 13 further includes a swivel bracket 51, together with a lower or second pivot means 53 connecting the swivel bracket 51 to the stern bracket 41 at a point below the first pivot means 45 for pivotal movement of the swivel bracket 51 relative to the stern bracket 41 about a second or lower pivot axis 55 which is parallel to the first or upper pivot axis 47. Any means for effecting such pivotal connection can be employed.

The means 21 for pivotally mounting the propulsion unit 13 further includes means 61 for pivotally connecting the propulsion unit 13 to the swivel bracket 51 for movement in common with the swivel bracket 51 about the first and second or upper and lower pivot axes 47 and 55 and for steering movement of the propulsion unit 13 about a generally vertical axis relative to the swivel bracket 51. Any suitable means can be provided for pivotally connecting the swivel bracket 51 and the propulsion unit 13 and any suitable means can be employed for effecting steering displacement in a horizontal plane of the propulsion unit 13 relative to the swivel bracket 51.

The outboard motor 11 also includes means for displacing the swivel bracket 51 and connected propulsion unit 13 about the lower horizontal pivot axis 55 and about the upper horizontal pivot axis 47. In the construction illustrated in FIG. 1, such means comprises one or more tilt hydraulic cylinder-piston assemblies 65, each having an axis 67 and opposed ends 69 and 70. One end 69 is pivotally connected, by any suitable means, to the transom bracket means 31 and the other end 70 is pivotally connected, by any suitable means, to the stern bracket 41.

Figure 2:
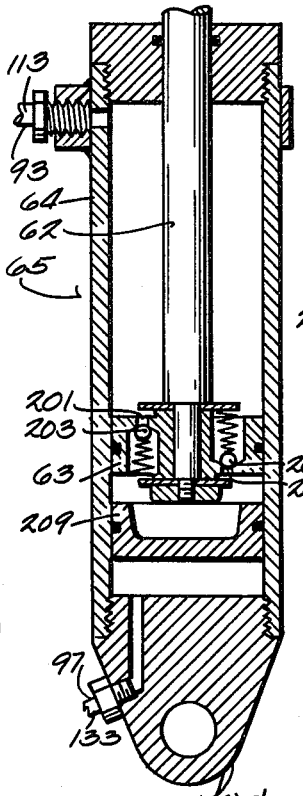
FIG. 2 is an enlarged cross-sectional view of the tilt cylinder-piston assembly incorporated in the outboard motor shown in FIG. 1.

While other arrangements could be employed, in the disclosed construction, the tilt cylinder-piston assembly 65 comprises (as shown best in FIG. 2) a tilt piston rod 62 having a first end pivotally connected to one of the stern bracket 41 and the transom bracket means 31, a tilt piston 63 fixed to the other or second end of the tilt piston rod 62, and a tilt cylinder 64 receiving the tilt piston 63 and having a first or rod end through which the tilt piston rod 62 passes and a second or blind end pivotally connected to the other of the stern bracket 41 and the transom bracket means 31. In the disclosed construction, the piston rod is pivotally connected to the transom bracket means 31 and the second or blind end of the cylinder 64 is pivotally connected to the stern bracket 41.

In addition, the means for pivotally displacing the swivel bracket 51 and connected propulsion unit 13 includes one or more trim cylinder-piston assemblies 71, each having an axis 73 and opposed ends 75 and 76. One end 75 is pivotally connected, by any suitable means, to the stern bracket 41, and the other end 76 is pivotally connected, by any suitable means, to the swivel bracket 51.

Figure 3:
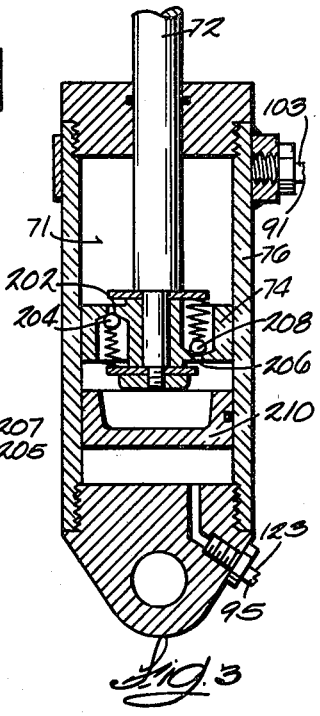
FIG. 3 is an enlarged cross-sectional view of the trim cylinder-piston assembly incorporated in the outboard motor shown in FIG. 1.

While other arrangements are possible, in the disclosed construction, the trim cylinder-piston assembly 71 includes (as shown best in FIG. 3) a trim piston rod 72 having a first end pivotally connected to the swivel bracket 51, a trim piston 74 fixed on the other or second end of the trim piston rod 72, and trim cylinder 76 receiving the trim piston and having a first or rod end through which the trim piston rod 72 passes and a second or blind end pivotally connected to the stern bracket 41.

In order to provide for sequential upward pivotal propulsion unit movement through the trim range and then through the tilt range when under thrust conditions, the pivotal connections of the trim cylinder-piston assembly 71 and the tilt cylinder-piston assembly 65 are located such that, when the swivel bracket 51 and connected propulsion unit 13 are in the lowermost position, the ratio of the perpendicular distances from the lower or second pivot axis 55 to the axis of the propeller 15 and to the axis 73 of the trim cylinder-piston assembly 71 is less than the ratio of the perpendicular distances from the upper or first horizontal axis 47 to the axis of the propeller 15 and to the axis 67 of the tilt cylinder-piston assembly 65.

More specifically, it is noted that the moment arm between the upper pivot or tilt axis 47 and axis 67 of the tilt cylinder-piston assembly 65 is several times less than (approximately 20 percent of) the moment arm from the upper pivot or tilt axis 47 to the axis of the propeller 15. It is also noted that the moment arm from the lower pivot or trim axis 55 to the axis 73 of the trim cylinder-piston assembly 71 is less than (approximately 40 percent of) the moment arm from the lower pivot or trim axis 55 to the axis of the propeller 15. Thus, if the cross sectional dimension of the trim and tilt cylinder-piston assemblies 65 and 71 are about the same, substantially greater pressures are developed in the tilt cylinder-piston 65 assembly as compared to the trim cylinder-piston assembly 71 in response to propulsive thrust developed by the propeller 15.

Also included in the means for displacing the swivel bracket 51 and connected propulsion unit 13 about the upper and lower horizontal pivot axes 47 and 55, respectively, is (see especially FIG. 4) a source of pressure fluid 81 and a fluid conduit system 83. The source of pressure fluid 81 includes a reversible electric pump 85 having opposed first and second side ports 87 and 89 which alternately act as inlet and outlet ports depending upon the direction of pump rotation. The source of pressure fluid 81 communicates through the fluid conduit system 83 with a sump 92, which fluid conduit system 83 includes a first duct 94 including check valve means 96 permitting fluid flow therethrough from the sump 92 to the first side port 87 of the pump 85 and preventing reverse flow, and a second duct 98 including check valve means 100 permitting fluid flow therethrough from the sump 92 to the other or second side port 89 of the pump 85 and preventing reverse flow. If desired the duct 98 and check valve 100 can be omitted, but their inclusion serves to prevent pump cavitation. If desired a filter 90 can be employed between the sump 92 and the ducts 94 and 98.

The fluid conduit system 83 also connects the source of pressure fluid 81 to the tilt and trim, cylinder-piston assemblies 65 and 71, respectively. In this regard, the fluid conduit system 83 includes, in general, first, second, third, fourth and fifth conduit means 91, 93, 95, 97, and 99, respectively.

The first conduit means 91 includes first check valve means 101 dividing the first conduit means 91 into an upstream portion communicating with the first pump port 87 and a downstream portion 103 communicating with the first or rod end of the trim cylinder-piston 71, which first check valve means 101 is yieldably biased by a spring 105 to the closed position and is operative to permit flow from the upstream portion to the downstream portion 103 in response to the presence of fluid under pressure at the first pump port 87 and to permit flow from the downstream portion 103 to the upstream portion in response to the presence of fluid under pressure at the second pump port 89.

The second conduit means 93 includes second check valve means 111 dividing the second conduit means 93 into an upstream portion communicating with the first pump port 87 and a downstream portion 113 communicating with the first or rod end of the tilt cylinder-piston assembly 65, which second check valve means 111 is yieldably biased by a spring 115 to the closed position and is operative to permit flow from the upstream portion to the downstream portion 113 in response to the presence of fluid under pressure at the first pump port 87, and to permit flow from the downstream portion 113 to the upstream portion in response to the presence of fluid under pressure at the second pump port 89.

The third conduit means 95 includes third check valve means 121 dividing the third conduit means 95 into an upstream portion communicating with the second pump port 89 and a downstream portion 123 communicating with the second or blind end of the trim cylinder-piston assembly 71, which third check valve means 121 is yieldably biased by a spring 125 to the closed position and is operative to permit flow from the upstream portion to the downstream portion 123 in response to the presence of fluid under pressure at the second pump port 89, and to permit flow from the downstream portion 123 to the upstream portion in response to the presence of fluid under pressure at the first pump port 87.

The fourth conduit means 97 includes fourth check valve means 131 dividing the fourth conduit means 97 into an upstream portion communicating with the second pump port 89 and a downstream portion 133 communicating with the second or blind end of the tilt cylinder-piston assembly 65, which fourth check valve means 131 is yieldably biased by a spring 135 to the closed position and is operative to permit flow from the upstream portion to the downstream portion 131 in response to the presence of fluid under pressure at the second pump port 89.

The fifth conduit means 99 includes fifth combined check and pressure relief valve means 141 communicating between the downstream portion 123 of the third conduit means 95 and the downstream portion 133 of the fourth conduit means 97, which fifth check valve means 141 is biased closed by a spring 145 and is operable to prevent fluid flow from the downstream portion 123 of the third conduit means 95 to the downstream portion 133 of the fourth conduit means 97, and to permit fluid flow from the downstream portion 133 of the fourth conduit means 97 to the downstream portion 123 of the third conduit means 95 in response to the presence of fluid under pressure at a predetermined level in the downstream portion 133 of the fourth conduit means 97. The springs 105, 115, 125, 135 and 145 biasing the check valves 111, 121, 131, 141 and 151 are relatively light and, accordingly, in the absence of back pressure on these valves, little force is necessary to open them. In this last regard, in the disclosed construction, the fifth valve means is set to open at about 20 p.s.i.

Means are provided for opening the normally closed check valves 111 and 121 in the second and third conduit means 93 and 95 in response to pump operation. In this regard, a control piston 151 is located in a control cylinder 153 and includes axially extending pins 155 and 157 which, in response to piston movement in the control cylinder 153, are respectively engageable with the normally closed valves 111 and 121 for opening thereof.

Means are also provided for opening the normally closed check valve 101 in the first conduit means 91 in response to pump operation. In this regard, a control piston 161 is located in a control cylinder 163 and, at one end, includes an axially extending pin 165 which, in response to piston movement in the control cylinder 163, is engageable with the normally closed check valve 101 in the first conduit means 91 for opening thereof.

The control cylinders 153 and 163 communicate at their opposite ends, with the upstream portions of the first, second, third, and fourth conduit means 91, 93, 95, and 97 and with the side ports 87 and 89 of the pump 85. Thus, when the side port 87 is pressurized by the pump 85, the piston 151 moves to the right to open the normally closed check valve 121 in the third conduit means 95 so as thereby to enable drainage of fluid from the blind end of the trim cylinder-piston assembly 71 through the conduit means 95. Simultaneously, fluid under pressure as the side port 87 of the pump 85 acts, through the control cylinders 153 and 163, to open the normally closed valves 101 and 111 in the first and second conduit means 91 and 93 so as to enable supply of fluid under pressure through the conduit means 91 and 93 to the rod ends of the tilt and trim cylinder-piston assemblies 65 and 71. At the same time, the fourth check valve means 131 remains closed and drainage of fluid through the fourth conduit 97 from the blind end of the tilt cylinder-piston assembly 65 occurs when the pressure therein rises above the level set at the fifth check valve means 141.

When the side port 89 is pressurized by the pump 85, fluid under pressure serves to displace the pistons 151 and 161 to the left so as to open the normally closed check valve means 101 and 111 in the first and second conduit means 91 and 93 so as thereby to enable drainage of fluid through the conduits 91 and 93 from the rod ends of the tilt and trim cylinder piston assemblies 65 and 71. At the same time, the fluid under pressure in the control cylinder 151 operates to open the normally closed check valve means 121 in the third conduit means 95 so as to enable supply of pressure fluid through the conduit 95 to the blind end of the trim cylinder-piston assembly 65. Simultaneously, such fluid under pressure at the side port 89 opens the fourth check valve means 131 so as to enable supply of fluid under pressure through the fourth conduit means 97 to the blind end of the tilt cylinder-piston assembly 65.

In order to permit upward movement of the propulsion unit 13 in response to the striking of an underwater obstacle, the tilt piston 63 includes therein (see FIG. 2) an orifice 201 and a spring biased check valve 203 which opens in response to substantially increased pressure at the rod end of the tilt cylinder 64 so as to permit flow from the rod end of the tilt cylinder 64 to the area between the fixed piston 63 and the floating piston 209 of the tilt cylinder 64. Such movement of the fluid in the tilt cylinder 64 through the orifice 201 serves to permit extension of the tilt cylinder-piston assembly 65 ad to absorb energy during rapid upward swinging movement of the propulsion unit 13 in response to the striking of an underwater obstacle.

The tilt piston 63 also includes therethrough a second orifice 205 and a spring biased valve 207 which serves to yieldably prevent fluid flow from the area between the fixed piston 63 and the floating piston 209 of the tilt cylinder 64 to the rod end of the tilt cylinder 64. Such orifice permits contraction of the tilt cylinder-piston assembly 65 during down movement of the stern bracket 41 and connected propulsion unit 13 subsequent to the striking of an underwater obstacle by permitting return flow of hydraulic fluid from the blind end of the tilt cylinder 64 to the rod end of the tilt cylinder 64, keeping in mind that flow of hydraulic fluid from the blind end of the tilt cylinder 64 through the fourth conduit means 97 is prevented by the check valve 131.

Also in connection with upward movement of the propulsion unit 13 in response to the striking of an underwater obstacle, the trim piston 74 includes therein (see FIG. 3) an orifice 202 and a spring biased check valve 204 which opens in response to substantially increased pressure at the rod end of the trim cylinder 76 so as to permit flow from the rod end of the trim cylinder 76 to the area between the fixed piston 74 and the floating piston 210 of the trim cylinder 76. Such movement of the fluid in the trim cylinder 76 through the orifice 202 serves to permit extension of the trim cylinder-piston assembly 71 and to absorb energy during rapid upward swinging movement of the propulsion unit 13 in response to the striking of an underwater obstacle.

The trim piston 74 also includes therethrough a second orifice 206 and a spring biased valve 208 which serves to yieldably prevent fluid flow from the area between the fixed piston 74 and the floating piston 210 of the trim cylinder 76 to the rod end of the trim cylinder 76. Such orifice permits contraction of the trim cylinder-piston assembly 65 during down movement of the swivel bracket 51 and connected propulsion unit 13 subsequent to the striking of an underwater obstacle by permitting return flow of hydraulic fluid from the blind end of the trim cylinder 76 to the rod end of the trim cylinder 76, keeping in mind that flow of hydraulic fluid from the blind end of the trim cylinder 76 through the third conduit means 95 is prevented by the check valve 121.

In order to provide for memory after the striking of an underwater obstacle, i.e., in order to have the propulsion unit 13 return to its previously set position, the tilt cylinder-piston assembly 65 and the trim cylinder-piston assembly 71 respectively include floating non-valved pistons 209 and 210 which are respectively located between the blind end of the associated cylinder and the associated piston.

The fluid conduit system 83 also includes a manual release valve 211 which allows free travel of the tilt and trim cylinder-piston assemblies 65 and 71. The release valve 211 is sequentially operable to connect the downstream portion 113 of the second conduit means 93 through branch ducts 213 and 215 to the downstream portion 123 of the third conduit means 95 and then to additionally connect the downstream portion 113 of the second conduit means 93 through branch duct 217 with the downstream portion 133 of the fourth conduit means 97, while retaining communication between the second conduit means 93 and the third conduit means 95.

The manual release valve 211 includes a threaded valve member 219 which, in response to rotation thereof, is movable axially in a housing 221 and relative to the adjacent end of the branch duct 215. When in the fully closed position shown in FIG. 4, the end of the valve member 217 closes the branch duct 215 so as to prevent flow between the branch duct 213 and the branch duct 215. However, initial outward valve member movement to the left in FIG. 4 serves to displace the end of the valve member 219 away from the branch duct 215 and thereby to permit fluid flow from the branch duct 215 into an annular space 223 between the end of the valve member 219 and the housing 221, and to the branch duct 213. Further outward retraction toward the left in FIG. 4 of the valve member 219 serves to communicate an annular passage 225 forming a part of the branch duct 217 and the annular space 223 around the inner end of the valve member 219, thereby communicating the branch duct 217 with the second conduit means 93.

The fluid conduit system 83 also includes a pressure relief valve 251 which communicates between the first side port 87 of the pump 85 and the sump 92, as well as a pressure relief valve 261 which communicates between the sump 92 and the downstream portion 133 of the fourth conduit means 97. Still further in addition, the fluid conduit system 83 includes a pressure relief valve 271 which communicates between the sump 92 and the downstream portion 123 of the third conduit means 95. The pressure relief valves 251 and 261 are set to relieve pressure at a relatively low pressure greater than that of the fifth valve means 141, i.e., at about 1,500 p.s.i. in the disclosed embodiment, and the pressure relief valve 271 is set at a pressure higher than the pressure relief valves 251 and 261, i.e., at about 2,500 p.s.i. in the disclosed embodiment.

In operation, when the pump 85 is not energized, the check valves 101, 111, 121 and 131 are operative to prevent fluid flow in the system 83 and therefore to lock the trim and tilt cylinder piston assemblies 65 and 71 in their existing positions.

In the event of the striking of an underwater obstacle when moving in the forward direction, and with the pump 85 deenergized, the pressures exerted on the propulsion unit 13 will cause fluid flow through the orifice 201 in the tilt piston 63 from the rod end to the blind end of the tilt cylinder 64, and through the orifice 202 in the trim piston 74 from the rod end to the blind end of the trim cylinder 76, thereby permitting upward swinging of the stern bracket 41 and swivel bracket 51 relative to the transom bracket means 31. Such movement does not disturb the position of the floating pistons 209 and 210. Return movement of the propulsion unit 13 to the previous running position is afforded by return fluid flow through the orifice 205 in the tilt piston 63 and through the orifice 206 in the trim piston 74. Such movement occurs in response to geometry, and/or in response to "kick-back", and/or forward propulsion. Because the check valve 207 at the orifice 205 opens at a lower pressure than the fifth valve means 141, and because the fluid at the blind end of the tilt cylinder 64 is trapped between the floating piston 209 and the fifth valve means 141, the stern bracket 41 will return to its previously set tilt position.

In addition as the check valve 208 at the orifice 206 opens at a relatively light pressure and because the fluid at the blind end of the trim cylinder 76 is trapped between the floating piston 210 and the third valve means 121, the swivel bracket 51 will return to its previously set trim position.

Still further in addition, the relatively low pressure settings of the check valves 201 and 202 prevents hydraulic lock-up at the rod ends of the tilt and trim cylinders 64 and 76, when the tilt and trim cylinder-piston assemblies 65 and 71 are fully contracted and the pump 85 is deenergized, by permitting fluid flow from the rod end to the blind end of the associated cylinder.

Under forward thrust conditions, actuation of the pump 85 to cause upward swinging movement of the propulsion unit 13 will apply equal lifting force at both the trim and tilt cylinder assemblies 65 and 71 (assuming that the tilt and trim cylinders 64 and 76, respectively, are of equal diameter). Accordingly, because of geometric considerations, the trim cylinder-piston assembly 71 will first extend through the trim range and, thereafter, the tilt cylinder-piston assembly 65 will expand through the tilt range.

With respect to energization of the pump 85 to obtain down swinging movement of the propulsion unit 13 under forward thrust conditions, and assuming the diameters of the tilt and trim cylinders 64 and 76, respectively, are equal, because of geometric considerations, the tilt cylinder-piston assembly 65 will first contract, followed by contraction of the trim cylinder-piston assembly 71 after full contraction of the tilt cylinder-piston assembly 65.

Referring to reverse thrust operation when the pump 85 is deactivated, such reverse thrust tends to swing the propulsion unit 13 upwardly and thereby causes pressure buildup at the rod end of the tilt and trim cylinders 64 and 76. Because of geometric considerations, i.e., because the moment arm to the tilt cylinder 64 is less than the movement arm to the trim cylinder 76, the resulting pressure at the rod end of the tilt cylinder 64 is greater than at the rod end of the trim cylinder 76. When the pump 85 is not actuated, as already pointed out, the check valves 101, 111, 121 and 131 serve to prevent flow to or from the tilt and trim cylinders 64 and 76, respectively, and thereby hold the tilt and trim cylinders 64 and 76 in the previously adjusted position. However, when the pump 85 is actuated to cause upward singing movement of the propulsion unit 13, such operation will tend to cause the control pistons 151 and 161 to move toward the left to open the check valves 111 and 101 so as to permit drainage of fluid from the rod ends of the tilt and trim cylinders 64 and 76, respectively.

Because the pressure at the rod end of the tilt cylinder 64 is greater than the pressure at the rod end of the trim cylinder 76, and because such pressures are applied as back pressures to the check valves 111 and 101, the control piston 161 will initially open the trim cylinder check valve 101, thereby permitting extension of the trim cylinder-piston assembly 71 to displace the propulsion unit 13 through the trim range. Upon full extension of the trim cylinder-piston assembly 71, the pump pressure will build to permit opening of the tilt cylinder check valve 111, thereby permitting extension of the tilt cylnder-piston assembly 65 to displace the propulsion unit 13 through the tilt range. Thus, the trim cylinder-piston assembly 71 first extends, followed by extension of the tilt cylinder-piston assembly 65.

Referring now to actuation of the pump 85 to swing the propulsion unit 14 downwardly during reverse thrust conditions, as already mentioned, reverse thrust tends to swing the propulsion unit 13 upwardly and thus the pump 85 must overcome the pressure conditions at the rod ends of the tilt and trim cylinders 64 and 75, respectively, occasioned by such reverse thrust. As already pointed out, the pressure at the rod end of the trim cylinder 76 is less than the pressure at the rod end of the tilt cylinder 64, and thus application of fluid under pressure to the rod ends of the tilt and trim cylinders 64 and 76 will initially cause contraction of the trim cylinder-piston assembly 71, followed by contraction of the tilt cylinder-piston assembly 65. Thus, operation of the pump 85 to obtain down swinging movement of the propulsion unit 13 during reverse thrust conditions can result in a condition in which the propulsion unit is in a lowered position with the trim cylinder-piston assembly 71 fully retracted and with the tilt cylinder-piston assembly 65 partially extended, just the opposite of the desired condition wherein the tilt cylinder-piston assembly 65 is retained in fully contracted condition until after full extension of the trim cylinder-piston assembly 71.

Significantly, however, when reverse thrust is terminated, and assuming the pump 85 to be deactivated, either the operation of gravity, or a condition of forward thrust, will, because of geometry considerations, cause increased pressure at the blind end of the tilt cylinder 64 are compared to at the blind end of the trim cylinder 76. The increased pressure at the blind end of the tilt cylinder 64 will, acting through the downstream portion 133 of the fourth conduit means 97 and through the fifth conduit means 99, open the fifth valve means 141 permitting fluid flow from the blind end of the tilt cylinder 64 and sequentially through the fourth, fifth and third conduit means 97, 99 and 95, to the blind end of the trim cylinder 76 and thus causing extension of the trim cylinder piston assembly 71 and simultaneous retraction of the tilt cylinder-piston assembly 65 until the trim cylinder-piston assembly 71 is fully extended and the tilt cylinder-piston assembly 65 is partially extended or until the tilt cylinder-piston assembly 65 is fully retracted and the trim cylinder-piston assembly 71 is partially extended. Thus the check valve 141 permits reorientation of the extension of the trim and tilt cylinder-piston assemblies 65 and 71 so that the trim cylinder-piston assembly 71 is extended before any extension of the tilt cylinder-piston assembly 65.

Figure 4:
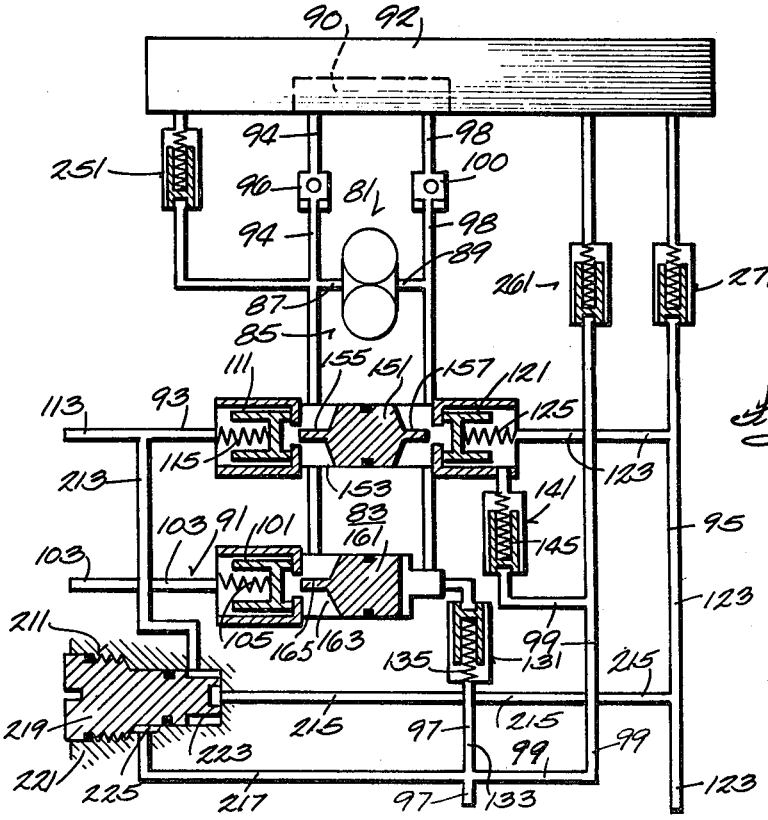
FIG. 4 is a schematic view of the pressure fluid supply and conduit system included in the outboard motor shown in FIG. 1.

Displacement of the propulsion unit 13 from a raised position to a lowered position when the pump 85 is deactivated can be obtained by rearwardly partially withdrawing the valve member 219 to the left in FIG. 4, thus communicating the branch conduits 213 and 215 and thus the second and third conduit means 93 and 95. Under such circumstances, the weight of the propulsion unit 13 will cause development of pressures at the blind end of the tilt and trim cylinders 64 and 76, respectively. Due to geometric considerations, the pressure at the blind end of the tilt cylinder 64 will be greater than the pressure at the blind end of the trim cylinder 76, and such pressure, operating through the fourth conduit means 97 and through the fifth conduit means 99 will open the fifth valve means 141 to permit flow from the blind end of the tilt cylinder piston assembly 65 through the fifth valve means 141 to the downstream portion 123 of the third conduit means 95, through the branch conduit 215, through the valve 211, through the branch conduit 213, and through the downstream portion 113 of the second conduit means 93 to the rod end of the tilt cylinder 64.

As all of the fluid from the blind end of the tilt cylinder 65 cannot be accommodated at the rod end of the tilt cylinder 64, the tilt-cylinder piston assembly 65 will not be completely contracted when the rod end of the tilt cylinder 64 fills with fluid. At this time, the weight of the propulsion unit 13 is solely carried by the piston rod 62, whereby to substantially increase the pressure on the hydraulic fluid so as to open the pressure relief valve 261 and thereby permit drainage of the remaining fluid from the blind end of the tilt cylinder piston assembly 65 to the sump 92. Thus, partial withdrawal of the valve member 219 permits contraction of the tilt cylinder-piston assembly 65 from the fully extended condition wherein the propulsion unit 13 is in a raised position to the fully contracted position wherein the propulsion unit 13 is in a lowered position.

Further withdrawal of the valve member 219 provides communication between the branch conduits 213 and 217 and therefore directly between the downstream portion 113 of the second conduit means 93 and the downstream portion 133 of the fourth conduit means 97, thereby directly communicating the rod end and the blind end of the tilt cylinder 64 in bypassing relation to the fifth valve means 141. With such direct communication, the propulsion unit 13 can be manually lifted as desired between a lowered position and a raised position.

Completel withdrawal of the valve member 219 from the housing 221 facilitates introduction of the hydraulic fluid into the system 83 from a suitable external source of fluid under pressure.

The pressure relief valve 251 operates, in the event of excessive pressure at the side port 87 of the pump 85 so as to permit return flow from the pump 85 to the sump 92. The pressure relief valve 261 operates, in response to excessive pressure at the side port 89 of the pump 85, or in response to excessive pressure at the blind end of the tilt-cylinder piston assembly 65, to permit return flow of fluid to the sump 92. The valves 251 and 261 thereby prevent pump overload when the propulsion unit 13 is in its lowermost and full tilt positions. The valve 261 also serves to limit the amount of forward thrust which can be carried by the tilt cylinder-piston assembly 65 when the propulsion unit 13 is operating in a shallow water drive condition within the tilt range so as thereby to avoid the possibility of structural damage to the marine propulsion device in the event of excessive thrust. The pressure relief valve 261 also serves to permit return flow to the sump 92 from the blind end of the tilt cylinder 64 when the propulsion unit 13 descends under gravity and when the valve member 219 is partially withdrawn as already explained.

The pressure relief valve 271 operates, in response to pressure in the system 83 above the level set at the relief valve 261 or in response to excessive pressure at the blind end of the trim cylinder-piston assembly 71 to permit return flow of pressure fluid to sump 92.

Various features of the invention are set forth in the following claims.

We claim:

1. A marine propulsion device comprising transom bracket means adapted to be connected to a boat transom, a stern bracket, first pivot means connecting said stern bracket to said transom bracket means for pivotal movement therebetween about a first pivot axis which is horizontal when said transom bracket means is boat mounted, a swivel bracket, second pivot means connecting said swivel bracket to said stern bracket for pivotal movement with said stern bracket and relative to said stern bracket about a second pivot axis parallel to said first pivot axis, a propulsion unit including, at the lower end thereof, a rotatably mounted propeller, means pivotally connecting said propulsion unit to said swivel bracket for steering movement relative to said swivel bracket and for common pivotal movement with said swivel bracket, a trim cylinder-piston assembly pivotally connected to said stern bracket and to said swivel bracket and including first and second ends, a tilt cylinder-piston assembly pivotally connected to said transom bracket means and to said stern bracket and including first and second ends, a reversible pump including first and second ports, first conduit means including first valve means communicating between said first pump port and said first end of said trim cylinder-piston assembly, second conduit means including second valve means communicating between said first pump port and said first end of said tilt cylinder-piston assembly, third conduit means including third valve means dividing said third conduit means into an upstream portion communicating with said second pump port and a downstream portion communicating with said second end of said trim cylinder-piston assembly, fourth conduit means including fourth valve means dividing said fourth conduit means into an upstream portion communicating with said second pump port and a downstream portion communicating with said second end of said tilt cylinder-piston assembly, and fifth conduit means including fifth valve means communicating between said downstream portion of said third conduit means and said downstream portion of said fourth conduit means, said fifth valve means being operable to prevent fluid flow from said downstream portion of said third conduit means to said downstream portion of said fourth conduit means, and to permit fluid flow from said downstream portion of said fourth conduit means to said downstream portion of said third conduit means in response to the presence of fluid under pressure above a predetermined level in said downstream portion of said fourth conduit means.

2. A marine propulsion device in accordance with claim 1, wherein at least one of said cylinder-piston assemblies includes a cylinder having first and second ends corresponding to said first and second ends of the associated cylinder-piston assembly, a first piston located in said cylinder, a piston rod connected to said first piston and extending through said first end of said cylinder, and a floating piston located in said cylinder between said first piston and said second end of said cylinder.

3. A marine propulsion device in accordance with claim 1 and further including manually operative valve means movable between a first position wherein said valve means is closed, a second position wherein said second conduit means communicates, downstream of said second valve means, with said third conduit means, downstream of said third valve means, to permit fluid flow, in response to the presence of fluid under pressure above said predetermined level, from said fourth conduit means, through said fifth conduit means, and through said third conduit means to said second conduit means, and a third position wherein said second conduit means communicates, downstream of said second valve means, with each of said third and fourth conduit means, downstream of said third and fourth valve means, to permit fluid flow between said second conduit means and said third and fourth conduit means.

4. A marine propulsion device in accordance with claim 1 wherein said first valve means divides said first conduit means into an upstream portion communicating with said first pump port and a downstream portion communicating with said first end of said trim cylinder-piston assembly, said first valve means being yieldably biased to the closed position and being operative to permit flow from said upstream portion to said downstream portion in response to the presence of fluid under pressure at said first pump port, and to permit flow from said downstream portion to said upstream portion in response to the presence of fluid under pressure at said second pump port.

5. A marine propulsion device in accordance with claim 1 wherein said second valve means divides said second conduit means into an upstream portion communicating with said first pump port and a downstream portion communicating with said first end of said tilt cylinder-piston assembly, said second valve means being yieldably biased to the closed position and being operative to permit flow from said upstream portion to said downstream portion in response to the presence of fluid under pressure at said first pump port, and to permit flow from said downstream portion to said upstream portion in response to the presence of fluid under pressure at said second pump port.

6. A marine propulsion device in accordance with claim 1 wherein said third valve means is yieldably biased to the closed position and is operative to permit flow from said upstream portion to said downstream portion in response to the presence of fluid under pressure at said second pump port, and to permit flow from said downstream portion to said upstream portion in response to the presence of fluid under pressure at said first pump port.

7. A marine propulsion device in accordance with claim 1 wherein said fourth valve means is yieldably biased to the closed position and is operative to permit flow from said upstream portion to said downstream portion in response to the presence of fluid under pressure at said second pump port.

8. A marine propulsion device in accordance with claim 1 and further including a sump, a first pressure relief valve communicating between said sump and said downstream portion of said third conduit means, said first pressure relief valve being operable to open at a first pressure level, and a second pressure relief valve communicating between said sump and said downstream portion of said fourth conduit means, said second pressure relief valve being operable to open at a second pressure level less than said first pressure level.

9. A marine propulsion device in accordance with claim 8 and further including a third pressure relief valve communicating between said sump and said first pump port, said third pressure relief valve being operable to open at a third pressure level substantially the same as said second pressure level.

10. A marine propulsion device comprising transom bracket means adapted to be connected to a boat transom, a stern bracket, first pivot means connecting said stern bracket to said transom bracket means for pivotal movement of said stern bracket relative to said transom bracket means about a first pivot axis which is horizontal when said transom bracket means is boat mounted, a swivel bracket, second pivot means connecting said swivel bracket to said stern bracket below said first pivot means for pivotal movement of said swivel bracket with said stern bracket and relative to said stern bracket about a second pivot axis parallel to said first pivot axis, a propulsion unit including, at the lower end thereof, a rotatably mounted propeller, means pivotally connecting said propulsion unit to said swivel bracket for steering movement of said propulsion unit relative to said swivel bracket about a generally vertical axis and for common pivotal movement with said swivel bracket in a vertical plane about said first and second horizontal axes, a trim cylinder-piston assembly pivotally connected to said stern bracket and to said swivel bracket and including first and second ends, a tilt cylinder-piston assembly pivotally connect to said transom bracket means and to said stern bracket and including first and second ends, a reversible pump including first and second ports, said pump being operative, when said pump is operating in a first mode, to supply hydraulic fluid under pressure at said first port and to provide suction at said second port and being operative, when said pump is operating in a second mode, to supply hydraulic fluid under pressure at said second port and to provide suction at said first port, first conduit means including first check valve means dividing said first conduit means into an upstream portion communicating with said first pump port and a downstream portion communicating with said first end of said trim cylinder-piston assembly, said first check valve means being yieldably biased to the closed position and being operative to permit flow from said upstream portion to said downstream portion in response to the presence of fluid under pressure at said first pump port, and to permit flow from said downstream portion to said upstream portion in response to the presence of fluid under pressure at said second pump port, second conduit means including second check valve means dividing said second conduit means into an upstream portion communicating with said first pump port and a downstream portion communicating with said first end of said tilt cylinder-piston assembly, said second check valve means being yieldably biased to the closed position and being operative to permit flow from said upstream portion to said downstream portion in response to the presence of fluid under pressure at said first pump port, and to permit flow from said downstream portion to said upstream portion in response to the presence of fluid under pressure at said second pump port, third conduit means including third check valve means dividing said third conduit means into an upstream portion communicating with said second pump port and a downstream portion communicating with said second end of said trim cylinder-piston assembly, said third check valve means being yieldably biased to the closed position and being operative to permit flow from said upstream portion to said downstream portion in response to the presence of fluid under pressure at said second pump port, and to permit flow from said downstream portion to said upstream portion in response to the presence of fluid under pressure at said first pump port, fourth conduit means including fourth check valve means dividing said fourth conduit means into an upstream portion communicating with said second pump port and a downstream portion communicating with said second end of said tilt cylinder-piston asembly, said fourth check valve means being yieldably biased to the closed position and being operative to permit flow from said upstream portion to said downstream portion in response to the presence of fluid under pressure at said second pump port, fifth conduit means including check valve means communicating between said downstream portion of said third conduit means and said downstream portion of said fourth conduit means, said fifth check valve means being operable to prevent fluid flow from said downstream portion of said third conduit means to said downstream portion of said fourth conduit means, and to permit fluid flow from said downstream portion of said fourth conduit means to said downstream portion of said third conduit means in response to the presence of fluid under pressure above a predetermined level in said downstream portion of said fourth conduit means, a sump, a first pressure relief valve communicating between said sump and said downstream portion of said third conduit means, said first pressure relief valve being operable to open at a first pressure level, and a second pressure relief valve communicating between said sump and said downstream portion of said fourth conduit means, said second pressure valve being operable to open at a second pressure level less than said first pressure level.

11. A marine propulsion device in accordance with claim 10 and further including a third pressure relief valve communicating between said sump and said first pump port, said third pressure relief valve being operable to open at a third pressure level substantially the same as said second pressure level.

12. A marine propulsion device in accordance with claim 10 wherein at least one of said cylinder-piston assemblies includes a cylinder having first and second ends corresponding to said first and second ends of the associated cylinder-piston assembly, a first piston located in said cylinder, a piston rod connected to said first piston and extending through said first end of said cylinder, and a floating piston located in said cylinder between said first piston and said second end of said cylinder.

13. A marine propulsion device in accordance with claim 10 and further including manually operative valve means movable between a first position wherein said valve means is closed, a second position wherein said downstream portion of said second conduit means communicates with said downstream portion of said third conduit means to permit fluid flow, in response to the presence of fluid under pressure above said predetermined level, from said downstream portion of said fourth conduit means, through said fifth conduit means, and through said downstream portion of said third conduit means to said second conduit means, and a third position wherein said downstream portion of said second conduit means communicates with each of said downstream portions of said third and fourth conduit means to permit fluid flow between said downstream portion of said second conduit means and said downstream portions of said third and fourth conduit means.

14. A marine propulsion device comprising transom bracket means adapted to be connected to a boat transom, a stern bracket, first pivot means connecting said stern bracket to said transom bracket means for pivotal movement therebetween about a first pivot axis which is horizontal when said transom bracket means is boat mounted, a swivel bracket, second pivot means connecting said swivel bracket to said stern bracket for pivotal movement with said stern bracket and relative to said stern bracket about a second pivot axis parallel to said first pivot axis, a propulsion unit including, at the lower end thereof, a rotatably mounted propulsion element, means pivotally connecting said propulsion unit to said swivel bracket for steering movement relative to said swivel bracket and for common pivotal movement with said swivel bracket, a trim cylinder-piston assembly pivotally connected to said stern bracket and to said swivel bracket, a tilt cylinder-piston assembly pivotally connected to said transom bracket means and to said stern bracket, a reversible pump including first and second ports, first conduit means communicating between said first pump port and one end of said trim cylinder-piston assembly, second conduit means communicating between said first pump port and one end of said tilt cylinder-piston assembly, third conduit means including first valve means dividing said third conduit means into an upstream portion communicating with said second pump port and a downstream portion communicating with the other end of said trim cylinder-piston assembly, second conduit means including second valve means dividing said fourth conduit means into an upstream portion communicating with said second pump port and a downstream portion communicating with the other end of said tilt cylinder-piston assembly, and third conduit means including third valve means communicating between said downstream portion of said third conduit means and said downstream portion of said fourth conduit means, said third valve means being operable to prevent fluid flow from said downstream portion of said third conduit means to said downstream portion of said fourth conduit means, and to permit fluid flow from said downstream portion of said fourth conduit means to said downstream portion of said third conduit means in response to the presence of fluid under pressure above a predetermined level in said downstream portion of said fourth conduit means.

* * * * *